US009330628B2

(12) United States Patent
Hu et al.

(10) Patent No.: US 9,330,628 B2
(45) Date of Patent: May 3, 2016

(54) DRIVE CIRCUIT, DISPLAY PANEL, DISPLAY DEVICE AND DRIVE METHOD

(71) Applicants: Xiamen Tianma Micro-Electronics Co., Ltd., Xiamen (CN); Tianma Micro-Electronics Co., Ltd., Shenzhen (CN)

(72) Inventors: Shengpeng Hu, Xiamen (CN); Yuan Li, Xiamen (CN)

(73) Assignees: Xiamen Tianma Micro-Electronics Co., Ltd., Xiamen (CN); Tianma Micro-Electronics Co., Ltd., Shenzhen (CN)

( * ) Notice: Subject to any disclaimer, the term of this patent is extended or adjusted under 35 U.S.C. 154(b) by 55 days.

(21) Appl. No.: 14/464,361

(22) Filed: Aug. 20, 2014

(65) Prior Publication Data

US 2015/0340002 A1 Nov. 26, 2015

(30) Foreign Application Priority Data

May 20, 2014 (CN) ..... 2014 1 0213081

(51) Int. Cl.
*G09G 3/36* (2006.01)

(52) U.S. Cl.
CPC ..... *G09G 3/3696* (2013.01); *G09G 3/3607* (2013.01); *G09G 3/3666* (2013.01); *G09G 2320/0233* (2013.01); *G09G 2320/0247* (2013.01); *G09G 2320/0276* (2013.01)

(58) Field of Classification Search
None
See application file for complete search history.

(56) References Cited

U.S. PATENT DOCUMENTS

2006/0132418 A1* 6/2006 Morita ..... G09G 3/3614 345/98
2007/0139343 A1 6/2007 Wang et al.
2009/0153533 A1* 6/2009 Umeda ..... G09G 3/3607 345/204
2009/0273743 A1 11/2009 Sawabe et al.
2012/0007894 A1* 1/2012 Shin ..... G09G 3/3648 345/690

FOREIGN PATENT DOCUMENTS

| | | | |
|---|---|---|---|
| CN | 1773601 | A | 5/2006 |
| CN | 103680431 | A | 3/2014 |
| JP | 5-249433 | A | 9/1993 |
| JP | 2000147456 | A | 5/2000 |
| JP | 2005025179 | A | 1/2005 |
| KR | 20080048327 | A | 6/2008 |

OTHER PUBLICATIONS

Office Action in corresponding Chinese Application No. 201410213081.3, dated Sep. 2, 2015.

* cited by examiner

*Primary Examiner* — Jason Olson
*Assistant Examiner* — Krishna Neupane
(74) *Attorney, Agent, or Firm* — Alston & Bird LLP

(57) ABSTRACT

A drive circuit of a display panel, a display panel, a display device and a method of driving a display device are provided. The circuit comprises: j select circuits and j data line signal output circuits, j is an integer greater than or equal to 2. Each data line is connected with a select circuit, different data lines are connected with different select circuits, each select circuit is connected with the j data line signal output circuits, each select circuit can control the data line connected therewith to be connected with one of these j data line signal output circuits and to control the data line connected therewith to be disconnected from the other ones of these j data line signal output circuits; so pixels at different locations can be scanned by powering the data lines connected with the pixels using the different data line signal output circuits.

15 Claims, 8 Drawing Sheets

DRIVE CIRCUIT, DISPLAY PANEL, DISPLAY DEVICE AND DRIVE METHOD

This application claims the benefit of priority to Chinese Patent Application No. 201410213081.3, filed with the Chinese Patent Office on May 20, 2014 and entitled "DRIVE CIRCUIT, DISPLAY PANEL, DISPLAY DEVICE AND DRIVE METHOD", the content of which is incorporated herein by reference in its entirety.

FIELD OF THE INVENTION

The present invention relates to the field of liquid crystal display technologies, and particularly to a drive circuit of a display panel, a display panel, a display device and a method of driving a display device.

BACKGROUND OF THE INVENTION

An array substrate of a Thin Film Transistor (TFT) Liquid Crystal Display (LCD) (TFT-LCD) is driven in a matrix of rows and columns, where the matrix of rows and columns is formed by N rows of gate lines and M columns of data lines which intersect each other to drive respective pixel elements in the matrix of rows and columns.

A common electrode line Vcom in the TFT-LCD traverses the entire display area. FIG. 1 illustrates a schematic structural diagram of an equivalent circuit driving pixel elements in a conventional TFT-LCD, where respective TFTs have gates connected with corresponding gate lines, sources connected with corresponding data lines and drains connected with pixel electrodes in corresponding pixel elements, and the respective pixel elements and the common electrode line Vcom (the common electrode line Vcom is typically at a negative level) constitute equivalent capacitors Ce. Particularly, the TFTs in FIG. 1 are n-type TFTs. Alternatively, the TFTs in the pixel circuits of the TFT-LCD can be p-type TFTs, or some TFTs in the pixel circuits of the TFT-LCD are p-type TFTs, and other TFTs are n-type TFTs.

The respective gate lines in the TFT-LCD are driven sequentially by a gate drive circuit in the TFT-LCD, and a data line is powered by a gamma circuit in the TFT-LCD at the voltage corresponding to an image to be displayed by pixels connected with the data line, that is, the respective pixel electrodes electrically connected with the data line are provided with data voltages so that the image to be displayed can be displayed at the respective pixels. Half the sum of a positive voltage at a grayscale of a pixel in a display panel at the edge of the display area and a negative voltage at the grayscale, i.e., the voltage Vcom of the common electrode line required for the pixel in the display panel at the edge of the display area, is not equal to half the sum of a positive voltage at a grayscale of a pixel in the display panel at the center of the display area and a negative voltage at the grayscale, i.e., the voltage Vcom of the common electrode line required for the pixel in the display panel at the center of the display area due to some reason in a process of manufacturing the display panel, and the same voltage is provided on the common electrode line throughout the display panel, so the flicker at the pixel in the display panel at the edge of the display area may differ from the flicker at the pixel in the display panel at the center of the display area at the same common voltage Vcom, thus resulting in non-uniformity of flicker over the display panel.

For example, given an existing display panel, the reliability of which was tested at high temperature and high humidity, the flicker at a pixel at the center of a display area of the display panel (the flicker at a pixel can be measured directly by an instrument, and the larger a measurement value is, the higher the flicker at the pixel will be) was −51.01 dB, while the flicker at a pixel at the edge of the display area of the display panel was −20.24 dB, at the voltage of −0.45V on a common electrode line Vcom, and at this time the flicker at the pixel at the edge of the display area of the display panel was higher than the flicker at the pixel at the center of the display area of the display panel; and the flicker at the pixel at the edge of the display area of the display panel was down to only −50.97 dB, while the flicker at the pixel at the center of the display area of the display panel was −18.65 dB, at the adjusted voltage Vcom of −0.3V on the common electrode line, and at this time the flicker at the pixel at the center of the display area of the display panel was higher than the flicker at the pixel at the edge of the display area of the display panel. Given the same voltage Vcom of the common electrode line throughout the display panel, the flicker on the display panel may appear non-uniform at the same voltage Vcom of the common electrode line throughout the display panel.

In summary, different common voltages Vcom are required for the different pixels in the conventional display panel for obtaining the uniformity of flicker (that is, the lowest flicker throughout the display area of the display panel), that is, the voltage Vcom of the common electrode line required for a pixel at the edge of the display area of the display panel is different from the voltage Vcom of the common electrode line required for a pixel at the center of the display area. The same voltage Vcom of the common electrode line throughout the same display panel may result in the uniformity of flicker throughout the same display panel.

BRIEF SUMMARY OF THE INVENTION

Embodiments of the invention provide a drive circuit of a display panel, a display panel, a display device and a method of driving a display device.

An embodiment of the invention provides a drive circuit of a display panel that includes multiple pixels arranged in a matrix. The drive circuit comprises j select circuits and j data line signal output circuits, and j is an integer greater than or equal to 2.

Each data line on the display panel is connected with an associated select circuit, different data lines on the display panel are connected with different select circuits, and each of the select circuits is connected with the j data line signal output circuits. Any one of the data line signal output circuits is configured, when a pixel on the display panel is to be displayed, to generate a voltage signal from a grayscale value to be displayed at the pixel and to load the voltage signal onto a data line connected with the pixel. Each of the select circuits is configured to control its associated data line connected therewith to be connected with one of the j data line signal output circuits and to control the associated data line connected therewith to be disconnected from the other ones of the j data line signal output circuits; and when a same grayscale is required, at least two of j positive grayscale voltages output by the j data line signal output circuits are different, and negative grayscale voltages output by data line signal output circuits outputting different positive grayscale voltages are also different.

An embodiment of the invention provides a display panel comprising the above-described drive circuit of the display panel.

An embodiment of the invention provides a display device comprising the above-described drive circuit of the display panel.

An embodiment of the invention provides a method of driving a display device comprising a display panel and the drive circuit of the display panel according to the embodiment of the invention, the display panel in the display device comprising a plurality of gate lines and a plurality of rows of pixels, and each of the gate lines being electrically connected with one of the rows of pixels. The method comprises: controlling one of the j data line signal output circuits to be connected with a data line connected with one of the pixels in the display panel when a gate line, which is connected with the pixel, is enabled; wherein a flicker at the pixel when the data line connected with the pixel is powered by the one of the j data line signal output circuits is lower than a flicker at the pixel when the data line connected with the pixel is powered by any other one of the j data line signal output circuits when the gate line connected with the pixel is enabled; and providing the same common voltage on a common electrode line connected with the respective pixels in the display panel.

Embodiments of the invention have many advantages and benefits. For example, a drive circuit of a display panel, a display panel, a display device and a method of driving a display device are provided. Each select circuit can control the data line connected therewith to be connected with one of the j data line signal output circuits and to control the data line connected therewith to be disconnected from the other ones of the j data line signal output circuits; and when the same grayscale is required, at least two ones of j positive grayscale voltages output by the j data line signal output circuits are different, and negative grayscale voltages output by data line signal output circuits outputting different positive grayscale voltages are also different, so that the same grayscale can be displayed by applying different voltages of data signals to pixel electrodes to thereby improve the uniformity of flicker on the display panel.

DETAILED DESCRIPTION OF THE INVENTION

Embodiments of the invention provide a drive circuit of a display panel, a display panel, a display device and a method of driving a display device, where pixels at different locations in a display area of the display panel can be scanned by powering data lines connected with the pixels using different data line signal output circuits, and the same grayscale can be displayed by applying different voltages of data signals to pixel electrodes to compensate the non-uniformity of flicker on a conventional display panel as a result of different voltages of a common electrode line required for the pixels at different locations in the display area of the display panel for the uniformity of flicker despite the same voltage of the common electrode line is used throughout the conventional display panel to thereby improve the uniformity of flicker on the display panel.

Particular implementations of the drive circuit of a display panel, the display panel, the display device and the method of driving a display device according to the embodiments of the invention will be described below with reference to the drawings.

Figure 1:
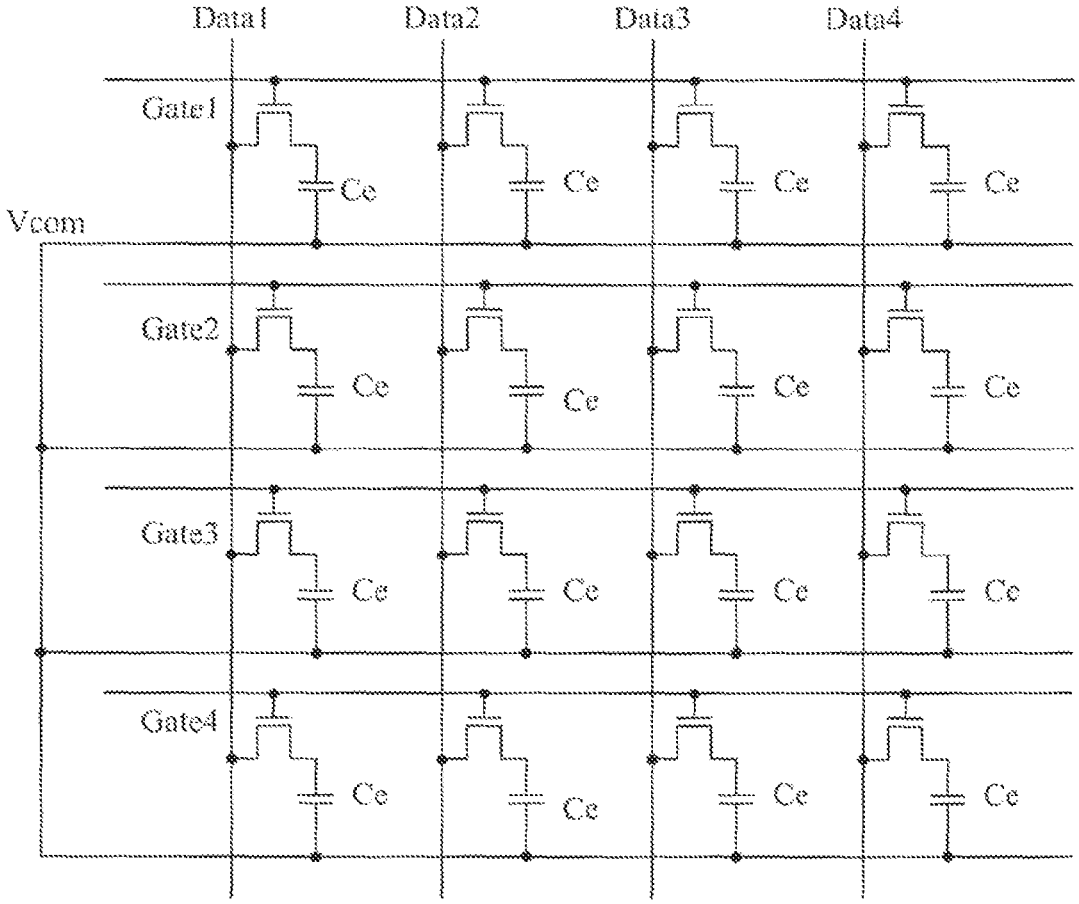
FIG. 1 (Prior Art)
FIG. 1 illustrates a schematic structural diagram of an equivalent circuit of a pixel element in a TFT-LCD in the prior art.
Figure 2:
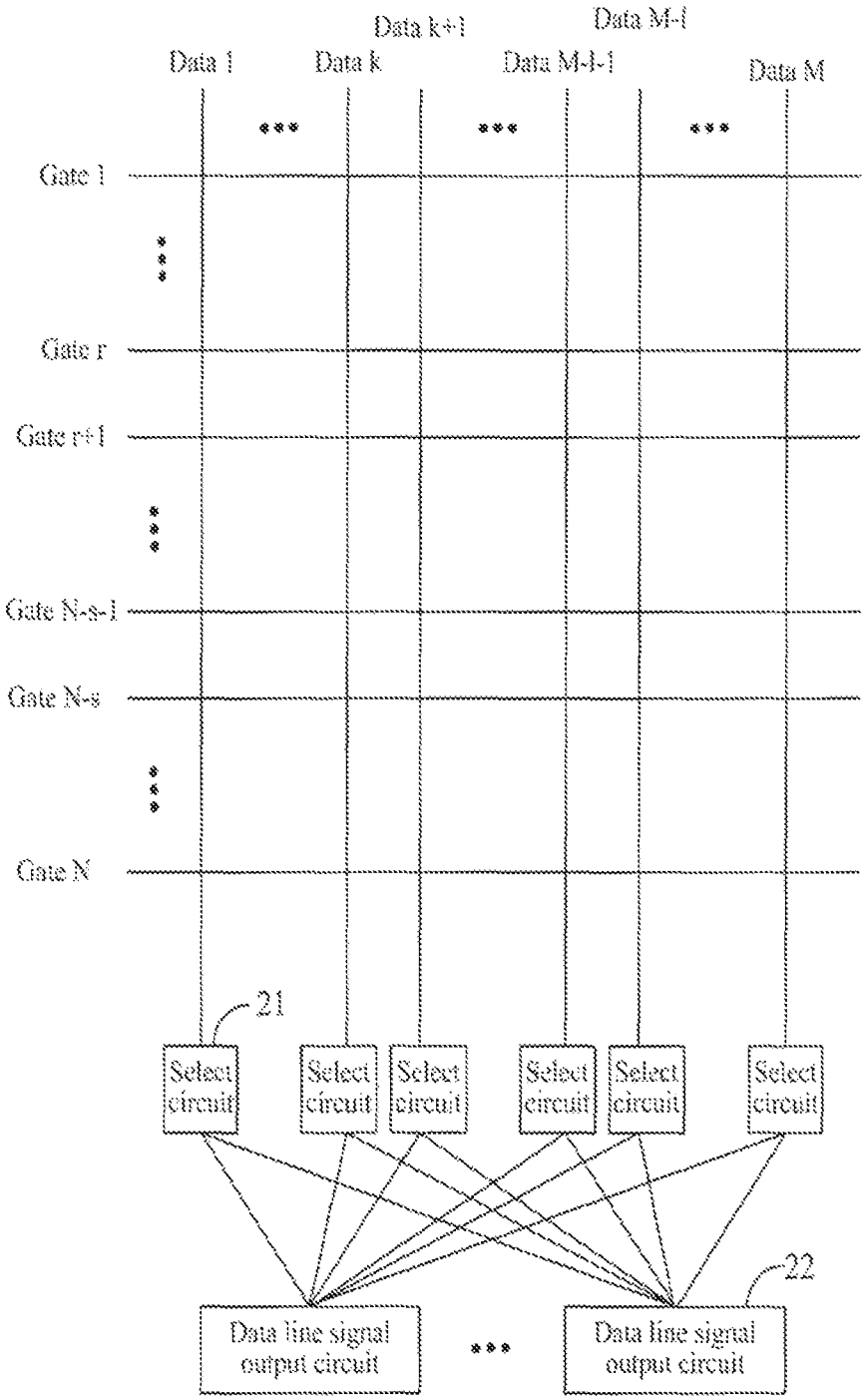
FIG. 2 illustrates a connection diagram of a drive circuit of a display panel according to an embodiment of the invention.

As illustrated in FIG. 2, an embodiment of the invention provides a drive circuit of a display panel, wherein the drive circuit comprises j select circuits 21 and j data line signal output circuits 22, and j is an integer greater than or equal to 2.

Each data line on the display panel is connected with an associated select circuit 21, different data lines on the display panel are connected with different associated select circuits 21, and each of the select circuits 21 is connected with the j data line signal output circuits 22;

Any one of the data line signal output circuits 22 is configured, when a pixel on the display panel is to be displayed, to generate a voltage signal from a grayscale value to be displayed at the pixel on the display panel and to load the voltage signal onto the data line connected with the pixel.

Each of the select circuits 21 is configured to control the associated data line connected therewith to be connected with one of the j data line signal output circuits 22 and to control the associated data line connected therewith to be disconnected from the other ones of the j data line signal output circuits 22.

When the same grayscale is required, at least two of j positive grayscale voltages output by the j data line signal output circuits 22 are different, and negative grayscale voltages output by data line signal output circuits 22 that output the at least two different positive grayscale voltages are also different.

The embodiment of the invention provides a drive circuit of a display panel, where each data line on the display panel is connected with a select circuit, different data lines on the display panel are connected with different select circuits, each of the select circuits is connected with the j data line signal output circuits, and each of the select circuits can control the data line connected therewith to be connected with one of these j data line signal output circuits and to control the data line connected therewith to be disconnected from the other ones of these j data line signal output circuits; and when the same grayscale is required, at least two of j positive grayscale voltages output by these j data line signal output circuits are different, and negative grayscale voltages output by data line signal output circuits outputting different positive grayscale voltages are also different, so pixels at different locations in a display area of the display panel can be scanned by powering the data lines connected with the pixels using the different data line signal output circuits to thereby prevent the problem of display non-uniformity from occurring even when the same common voltage is applied throughout the display panel. In other words, the same grayscale can be displayed by applying different voltages of data signals to pixel electrodes to make up for the drawback of the non-uniformity of flicker on the conventional display panel as a result of different voltages of a common electrode line required for the pixels at different locations in the display area of the existing display panel in order for the uniformity of flicker (the lowest flicker throughout the display panel) despite the desirable same voltage of the common electrode line is applied throughout the display panel to thereby improve the uniformity of flicker on the display panel.

It shall be noted that as the lowest flicker here refers to, different common voltages Vcom are applicable to the same pixel zone, there is some corresponding flicker appearing in the pixel zone at the value of each of the applicable common voltages Vcom, and the value (in dB) of the flicker is derived correspondingly. Thus in the entire debug or test process, there is always such one (e.g., VCOM) among the values of the applicable common voltages Vcom that the flicker in the pixel zone at the common voltage VCOM is lower than the flicker in the pixel zone at the values of the other common voltages Vcom, and then this common voltage value VCOM is the optimum Vcom value at which the flicker in the pixel zone is the lowest, and the flicker in the pixel zone at the common voltage VCOM applicable to the pixel zone is the lowest flicker in the pixel zone.

Preferably when the same grayscale is required to be displayed, for any two of the j data line signal output circuits 22, $V\mathbf{1}_{g+}-V\mathbf{2}_{g+}=V\mathbf{1}_{g-}-V\mathbf{2}_{g-}=Vcom_{1R}-Vcom_{2R}$, where $V\mathbf{1}_{g+}$ is the positive grayscale voltage output by the first one of two data line signal output circuits 22; $V\mathbf{2}_{g+}$ is the positive grayscale voltage output by the second one of the two data line signal output circuits 22 ("the first" and "the second" here are merely intended to distinguish the two data line signal output circuits from each other without specifying which one of them is "the first" and which of them is "the second"); $V\mathbf{1}_{g-}$ is the negative grayscale voltage output by the first data line signal output circuit, and $V\mathbf{2}_{g-}$ is the negative grayscale voltage output by the second data line signal output circuit; and $Vcom_{1R}$ is the voltage of the common electrode line required for the pixel connected with the data line powered by the first data line signal output circuit, and $Vcom_{2R}$ is the voltage of the common electrode line required for the pixel connected with the data line powered by the second data line signal output circuit; and where the difference between the flicker at the pixel connected with the data line powered by the first data line signal output circuit and the flicker at the pixel connected with the data line powered by the second data line signal output circuit lies in a preset range when the display panel is in operation.

For example, the voltage of a common electrode line required for a pixel in the middle area of a display panel is −0.45V, and the voltage of the common electrode line required for a pixel in the peripheral area of the display panel is −0.3V, and due to the same voltage of the common electrode line throughout the display panel, it will be sufficient to provide data lines with voltage signals using two data line signal output circuits in order to reduce the non-uniformity of flicker at the pixels in the display panel. Particularly when the same grayscale is required to be displayed, $VC_{g+}-VB_{g+}=Vcom_{CR}-Vcom_{BR}$, where $VC_{g+}$ is a positive grayscale voltage output by a data line signal output circuit powering a data line connected with the pixel in the middle area of the display panel when a gate line connected with the pixel in the middle area of the display panel is enabled; $VB_{g+}$ is a positive grayscale voltage output by a data line signal output circuit powering a data line connected with the pixel in the peripheral area of the display panel when a gate line connected with the pixel in the peripheral area of the display panel is enabled; $Vcom_{CR}$ is the voltage of the common electrode line required for the pixel in the middle area of the display panel; and $Vcom_{BR}$ is the voltage of the common electrode line required for the pixel in the peripheral area of the display panel; and $VC_{g-}-VB_{g-}=Vcom_{CR}-Vcom_{BR}$ at the same display grayscale, where $VC_{g-}$ is a negative grayscale voltage output by the data line signal output circuit powering the data line connected with the pixel in the middle area of the display panel when the gate line connected with the pixel in the middle area of the display panel is enabled; and $VB_{g-}$ is a negative grayscale voltage output by the data line signal output circuit powering the data line connected with the pixel in the peripheral area of the display panel when the gate line connected with the pixel in the peripheral area of the display panel is enabled.

If the voltage of a common electrode line on a display panel is −0.45V, and the voltage of the common electrode line required for a pixel in the middle area of the display panel is −0.45V, while the voltage of the common electrode line required for a pixel in the peripheral area of the display panel is −0.3V, then a grayscale displayed at a pixel is determined by the difference between the source voltage received at the pixel (the voltage provided on a data line, or the data signal voltage) and the voltage of a common electrode line connected therewith, so the voltage of the common electrode line connected with the pixel in the peripheral area of the display panel can be raised by 0.15V, that is, the common voltage originally required for the lowest flicker can be changed from −0.45V to the applicable common voltage of −0.3V, simply by raising the source voltage (the voltage provided on the data line) received at the pixel by 0.15V. Stated otherwise, if a grayscale of GL is displayed at the pixel in the middle area of the display panel at a positive voltage of V1 and a negative voltage of −V2, then at this time it will be sufficient to adjust a positive voltage and a negative voltage, at which the grayscale of GL is displayed at the pixel in the peripheral area of the display panel, from V1 to V1+0.15V and −V2 to −V2+0.15V so that the voltage of the common electrode line connected with the pixel in the peripheral area of the display panel from −0.45V to applicable −0.3V.

Optionally, the select circuits 21 in FIG. 2 can be controllable switches that are configured to selectively connect or disconnect circuits (or lines) that are connected with the switches, with or from each other as needed. For example, a controllable switch can be a single-pole multiple-throw switch or j Thin Film Transistors (TFTs) or the like.

When a controllable switch includes j thin film transistors, where each of the two terminals other than a gate of each of the thin film transistors is connected respectively with a data line and a different data signal output circuit connected with the controllable switch, and the data line connected with the each thin film transistor and the data signal output circuit connected with the thin film transistor is controlled at the gate of the thin film transistor to be connected or disconnected.

Optionally, the respective data line signal output circuits in FIG. 2 are gamma circuits, where the gamma circuits each are configured to output a grayscale voltage for a grayscale to be displayed at a pixel to power a data line connected with the pixel by outputting the grayscale voltage when a gate line, which is connected with the pixel, is enabled. The construction of a gamma circuit itself and the function performed by the gamma circuit itself are not focused upon in the embodiments of the invention but well known to those skilled in the art, so the construction of the gamma circuit itself and the function performed by the gamma circuit itself will not be described here in details.

An embodiment of the invention provides a display panel comprising the drive circuit of a display panel according to any one of the above-described embodiments.

In practice, the drive circuit of a display panel according to the embodiment of the invention can be located on the display panel (e.g., in an Integrated Circuit (IC) which can be integrated on the display panel) or can be located outside of the display panel or can be partially located on the display panel. For example, the select circuits in the drive circuit of a display panel may be located on the display panel, and the remaining components in the drive circuit may not be located on the display panel.

An embodiment of the invention provides a display device comprising the drive circuit of a display panel according to the embodiment of the invention.

Figure 3:
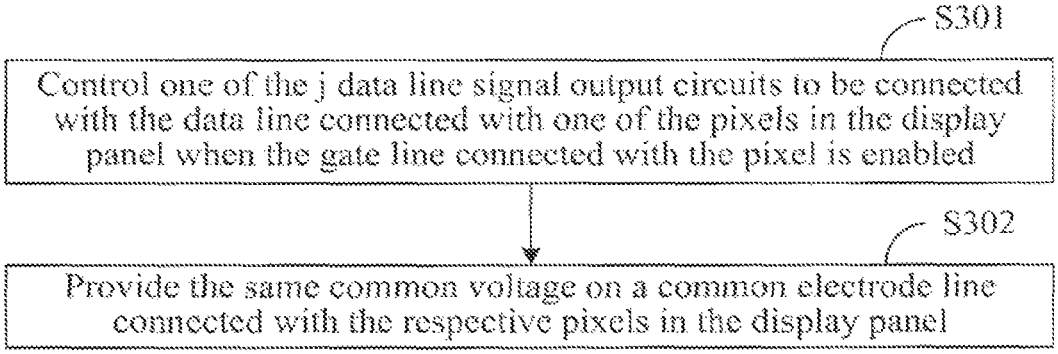
FIG. 3 illustrates a flow chart of a method of driving a display device according to an embodiment of the invention.

An embodiment of the invention provides a method of driving a display device comprising a display panel and the drive circuit of a display panel, where the display panel in the display device comprises a plurality of gate lines and a plurality of rows of pixels, and each of the gate lines is electrically connected with one of the rows of pixels, and as illustrated in FIG. 3, the method comprises:

At step S301: control one of the j data line signal output circuits to be connected with the data line connected with one of the pixels in the display panel when the gate line connected with the pixel is enabled.

The flicker at the pixel when the data line connected with the pixel is powered by the one of the j data line signal output circuits is lower than the flicker at the pixel when the data line connected with the pixel is powered by any other one of the j data line signal output circuits when the gate line connected with the pixel is enabled.

At step S302: provide the same common voltage on a common electrode line connected with the respective pixels in the display panel.

It will be appreciated by those skilled in the art that steps S301 and S302 need not necessarily be performed in the order shown, but they can be performed concurrently or in a different sequence.

For example, a gate drive device in the embodiment of the invention comprises three data line signal output circuit which are a data line signal output circuit 1, a data line signal output circuit 2 and a data line signal output circuit 3 respectively; and when the gate line connected with one of the pixels in the display panel is enabled, the data line signal output circuit connected with the data line connected with the pixel is such one of these three data line signal output circuit that the flicker at the pixel is the lowest when the data line connected with the pixel is powered by that data line signal output circuit. If when the gate line connected with the pixel is enabled, the flicker at the pixel when the data line connected with the pixel is powered by the data line signal output circuit 1 is lower than both the flicker at the pixel when the data line connected with the pixel is powered by the data line signal output circuit 2 and the flicker at the pixel when the data line connected with the pixel is powered by the data line signal output circuit 3, then when the gate line connected with the pixel is enabled, the data line signal output circuit 1 will be controlled to be connected with the data line connected with the pixel, and both the data line signal output circuit 2 and the data line signal output circuit 3 will be controlled to be disconnected from the data line connected with the pixel, so that the data line connected with the pixel will be powered by the data line signal output circuit 1.

Generally a display area of the display panel can be divided into several zones. In order for the lowest flicker, there are different optimum Vcom values corresponding to the respective different zones due to a process or other reasons. As per the principle as stated above, if the same common voltage Vcom is applicable throughout the display panel, then the difference in optimum Vcom value between the different zones will be compensated correspondingly by voltage values of compensating data signals output by the respective data line signal output circuits so that the lowest flicker can be equivalently available in the respective zones at their optimum Vcom values when the same common voltage Vcom is applicable throughout the display panel.

Thus actually the data voltage values output by the data line signal output circuit 1, the data line signal output circuit 2 and the data line signal output circuit 3 are compensated data voltages, applicable to a specific common voltage Vcom value (which is applied throughout the display panel), at which the low flicker available only at the respective optimum Vcom values can be available respectively.

The data voltage values output by the data line signal output circuit 1, the data line signal output circuit 2 and the data line signal output circuit 3 will vary with the varying optimum Vcom values corresponding to the respective zones. The optimum Vcom values of the respective zones can be measured experimentally or otherwise, and the data voltage values output by the data line signal output circuit 1, the data line signal output circuit 2 and the data line signal output circuit 3 can also be adjusted correspondingly to the differences in Vcom value between these zones.

Moreover the least number of zones into which the display panel is divided is determined by such a least number of different voltages of the common electrode line required for the pixels in the display panel that the flicker at the respective pixels in the display panel can lie in a tolerable range, that is, the flicker can be uniform throughout the display panel.

Figure 4:
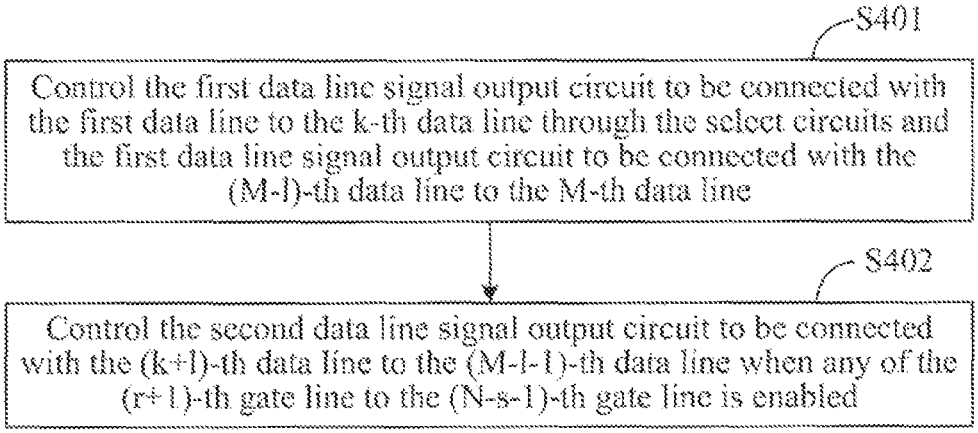
FIG. 4 illustrates a flow chart of a method of driving a display device according to an embodiment of the invention.

Particularly when the display panel can be divided into at least two zones, for example, one of which is the middle zone of the display panel, and the other one of which is the peripheral area of the display panel, then the flicker at the respective pixels in the display panel can lie in a tolerable range as long as the voltage of the common electrode line required for a pixel in the middle zone of the display panel is set different from the voltage of the common electrode line required for a pixel in the peripheral zone of the display panel. At this time the drive circuit of a display panel according to the embodiment of the invention can include only two data line signal output circuits which are a first data line signal output circuit and a second data line signal output circuit respectively. At this time the method of driving a display device according to the embodiment of the invention is illustrated in FIG. 4. The method comprises:

At step S401: control the first data line signal output circuit to be connected with the first data line to the k-th data line through the select circuits and the first data line signal output circuit to be connected with the (M−l)-th data line to the M-th data line, where k is an integer larger than 0 and smaller than or equal to M/2−1; 1 is an integer larger than or equal to 0 and smaller than or equal to M/2−1; and M is the number of data lines in the display panel; and At step S402: control the second data line signal output circuit to be connected with the (k+1)-th data line to the (M−l−1)-th data line when any of the (r+1)-th gate line to the (N−s−1)-th gate line is enabled, where r and s are integers, and r is an integer larger than 0 and smaller than or equal to N/2−1; s is an integer larger than or equal to 0 and smaller than or equal to N/2−1; and N is the number of gate lines in the display panel.

It will be appreciated by those skilled in the art that steps S401 and S402 need not necessarily be performed in a particular chronological sequence.

When the first data line signal output circuit is a first gamma circuit, the second data line signal output circuit is a second gamma circuit, and the select circuits each are a controllable switch, e.g., a single-pole multiple-throw switch or j thin film transistors. With the display panel is driven by the method illustrated in FIG. 4, the zones of the display panel are distributed as illustrated in FIG. 5, where a data line connected with a pixel in the zone 1 is powered by the first gamma circuit when a gate line connected therewith is enabled, and a data line connected with a pixel in the zone 2 is powered by the first gamma circuit when a gate line connected therewith is enabled.

Figure 5:
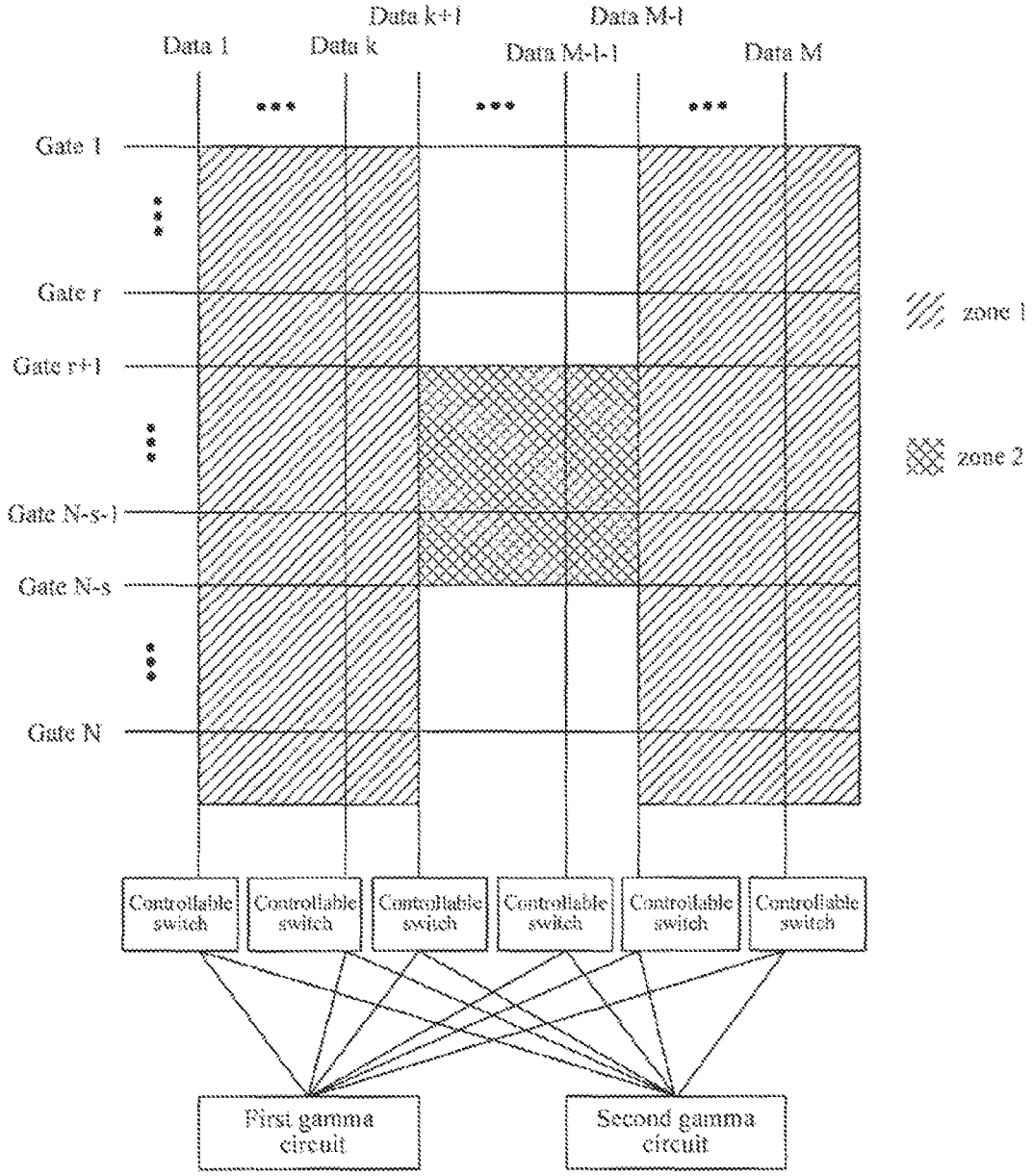
FIG. 5 illustrates a connection diagram of respective gamma circuits and data lines in a display panel in driving by the method of driving a display device illustrated in FIG. 4.

Particularly if the voltage of the common electrode line on the display panel illustrated in FIG. 5 is −0.45V, and the voltage of the common electrode line required for the pixel in the zone 2 of the display panel to have the lowest flicker is −0.45V, while the voltage of the common electrode line required for the pixel in the zone 1 of the display panel to have the lowest flicker is −0.3V, then if a positive voltage of V1 and a negative voltage of −V2 are output by the second gamma circuit at a grayscale of GL, then it will be sufficient to output an adjusted positive voltage of V1+0.15V and negative voltage of −V2+0.15V by the first gamma circuit. Thus the common voltage of −0.45V will be applicable throughout the display panel with an effect of the lowest flicker at the pixels in both the zone 1 and the zone 2.

As such with the method of driving a display device illustrated in FIG. 4, the flicker at the pixels in both the zone 1 and the zone 2 of the display panel illustrated in FIG. 5 will be the lowest at the same common voltage value applicable throughout the display panel, and at this time the flicker on the display panel will further tend to be uniform.

Figure 6:
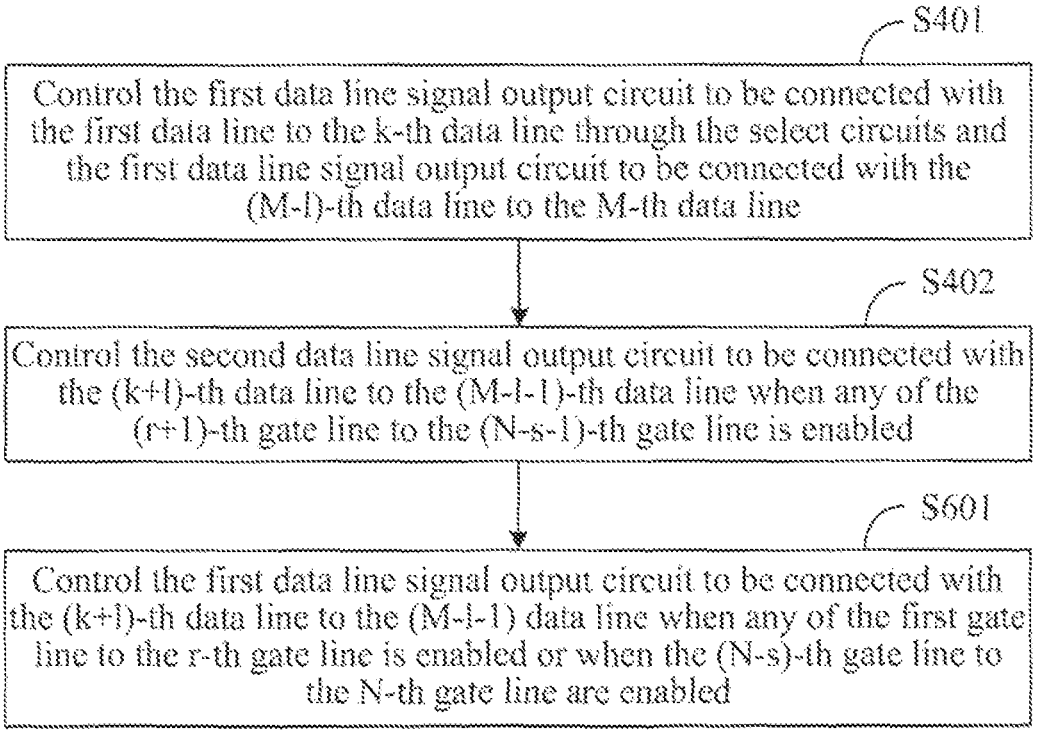
FIG. 6 illustrates a flow chart of a method of driving a display device according to an embodiment of the invention.

Furthermore, as illustrated in FIG. 6, the method of driving a display device according to the embodiment of the invention may further comprise:

At step S601: control the first data line signal output circuit to be connected with the (k+1)-th data line to the (M−1−1) data line when any of the first gate line to the r-th gate line is enabled or when the (N−s)-th gate line to the N-th gate line are enabled.

It will be appreciated by those skilled in the art that steps S401, S402, and S601 need not necessarily be performed in a particular chronological sequence.

When the first data line signal output circuit is a first gamma circuit, the second data line signal output circuit is a second gamma circuit, and the select circuits each are a controllable switch, e.g., a single-pole multiple-throw switch or j Thin Film Transistors (TFTs). With the display panel is driven by the method illustrated in FIG. 6, the zones of the display panel are distributed as illustrated in FIG. 7, where a data line connected with a pixel in the zone 1 is powered by the first gamma circuit when a gate line connected therewith is enabled, and a data line connected with a pixel in the zone 2 is powered by the first gamma circuit when a gate line connected therewith is enabled.

Figure 7:
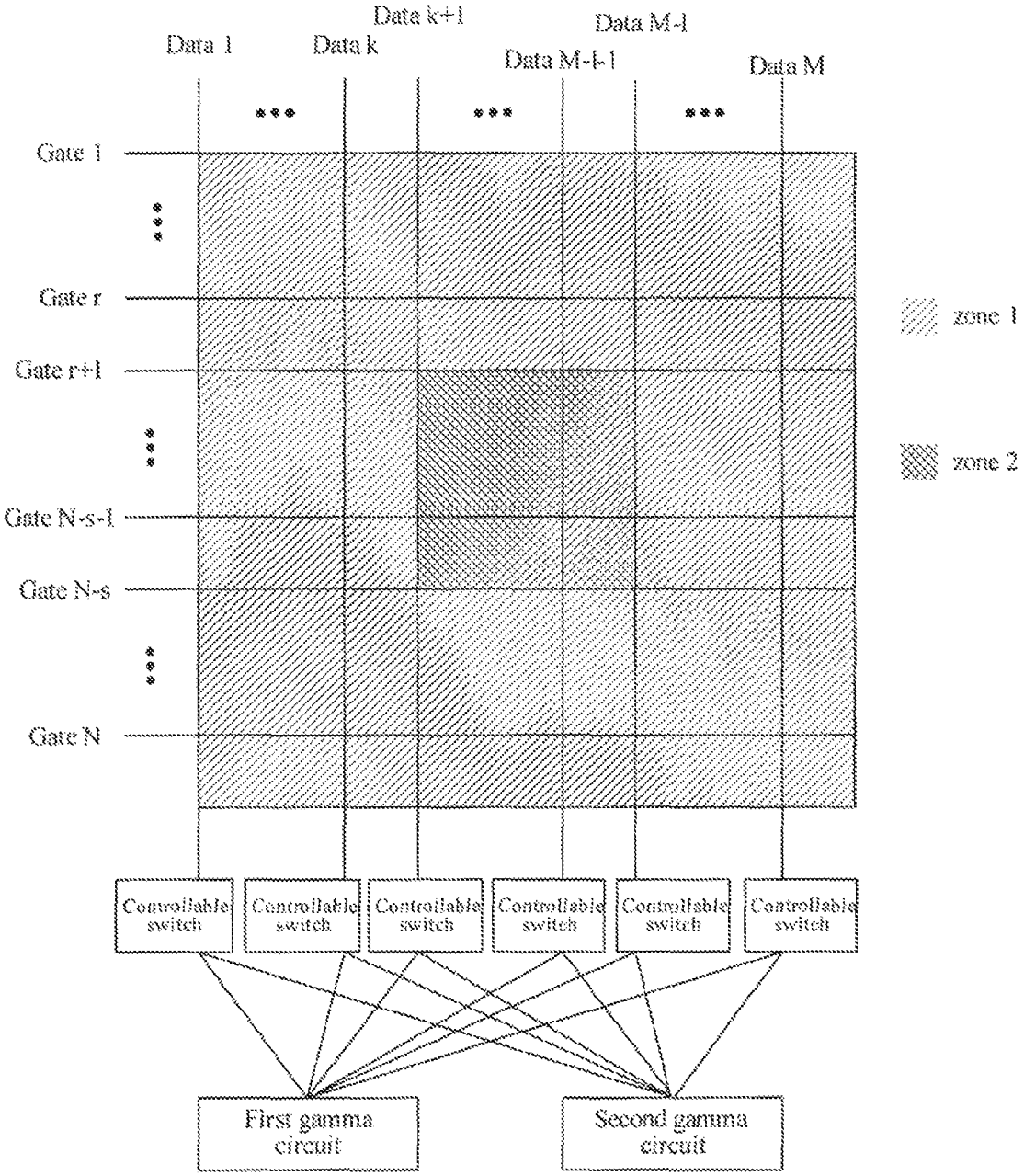
FIG. 7 illustrates a connection diagram of respective gamma circuits and data lines in a display panel in driving by the method of driving a display device illustrated in FIG. 6.

If the voltage of the common electrode line on the display panel illustrated in FIG. 7 is −0.45V, and the voltage of the common electrode line required for the pixel in the zone 2 of the display panel is −0.45V, while the voltage of the common electrode line required for the pixel in the zone 1 of the display panel is −0.3V, then if a positive voltage of V1 and a negative voltage of −V2 are output by the second gamma circuit at a grayscale of GL, then it will be sufficient to output an adjusted positive voltage of V1+0.15V and negative voltage of −V2+0.15V by the first gamma circuit.

With the method of driving a display device illustrated in FIG. 6, the flicker at the pixels in both the zone 1 and the zone 2 of the display panel illustrated in FIG. 7 will be the lowest, and at this time the flicker on the display panel will further tend to be uniform.

More generally the ranges of values for r, s, k and l can vary when the display panel can be divided into at least two zones other than the middle area of the display panel and the peripheral area of the display panel, or the display panel is divided into the zones not for the uniformity of flicker in the middle area of the display panel and the peripheral area of the display panel. Actually if the two zones are other than the middle area of the display panel and the peripheral area of the display panel, that is, the display panel can be divided into any two zones for the uniformity of flicker in these two zones or for the lowest flicker as described above in both of the two zones, and thus a difference from the embodiment above lies only in the division into the zones, then it will be sufficient to select the gate lines satisfying $1 \le r+1 \le N$ and $N-s \ge r+1$, so $0 \le r \le N-1$ and $s \le N-r-1$. Alike it will be sufficient to select the data lines satisfying $1 \le k+1 \le M$ and $k+l \le M-l$, so $0 \le k \le M-1$ and $l \le M-k-1$. For r, s, k and l satisfying such ranges of values and the correspondingly generated zone 1 and zone 2, the data voltage values output by the corresponding data line signal output circuits (e.g., gamma circuits) can be set according to the optimum Vcom values corresponding to the respective zones for the purpose of the lowest flicker in the respective zones or the uniformity of flicker through the display panel at the same common voltage Vcom applicable through the display panel.

Figure 8:
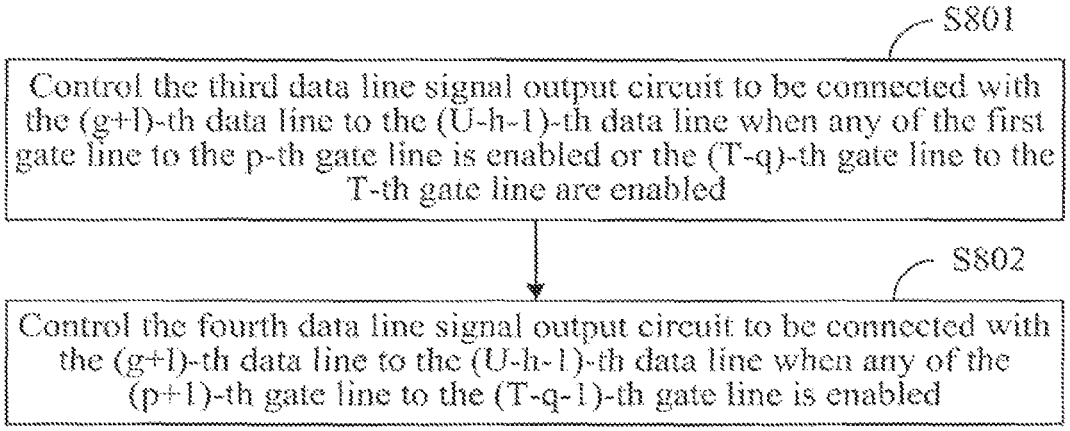
FIG. 8 illustrates a flow chart of a method of driving a display device according to an embodiment of the invention.

When the display panel can be divided into at least two zones, for example, one of which is the middle area of the display panel, and the other of which is the peripheral area of the display panel, then the flicker at the respective pixels in the display panel can lie in a tolerable range as long as a pixel in the middle zone and a pixel in the peripheral area of the display panel are provided respectively with their respective optimum voltage Vcom values of the common electrode line for the lowest flicker. At this time this condition can be handled equivalently by applying the same common voltage Vcom to the pixel in the middle zone and the pixel in the peripheral area of the display panel and connecting the different data line signal output circuits respectively for the pixels in the two zones to compensate the data signals output to the data lines to thereby cancel off the difference in optimum Vcom value between the different zones, thus also achieving an effect of the lowest flicker at the respective pixels in the respective zones. Particularly, the drive circuit of a display panel according to the embodiment of the invention comprises two data line signal output circuits which a third data line signal output circuit and a fourth data line signal output circuit respectively, and as illustrated in FIG. 8, the method of driving a display device according to the embodiment of the invention comprises:

At step S801: control the third data line signal output circuit to be connected with the (g+1)-th data line to the (U-h−1)-th data line when any of the first gate line to the p-th gate line is enabled or the (T-q)-th gate line to the T-th gate line are enabled, where p is an integer larger than 0 and smaller than or equal to T/2−1; q is an integer larger than or equal to 0 and smaller than or equal to T/2−1; T is the number of gate lines in the display panel; g is an integer larger than 0 and smaller than or equal to U/2−1; h is an integer larger than or equal to 0 and smaller than or equal to U/2−1; and U is the number of data lines in the display panel; and At step S802: control the fourth data line signal output circuit to be connected with the (g+1)-th data line to the (U-h−1)-th data line when any of the (p+1)-th gate line to the (T-q−1)-th gate line is enabled.

Steps S801 and S802 need not necessarily be performed in a particular chronological sequence, in accordance with some embodiments of the present invention.

Preferably the third data line signal output circuit is a third gamma circuit, the fourth data line signal output circuit is a fourth gamma circuit, and the select circuits each are a controllable switch, e.g., a single-pole multiple-throw switch or j Thin Film Transistors (TFTs). With the display panel is driven by the method illustrated in FIG. 8, the zones of the display panel are distributed as illustrated in FIG. 9, where a data line connected with a pixel in the zone 1 is powered by the third first gamma circuit when a gate line connected therewith is enabled, and a data line connected with a pixel in the zone 2 is powered by the fourth gamma circuit when a gate line connected therewith is enabled.

Figure 9:
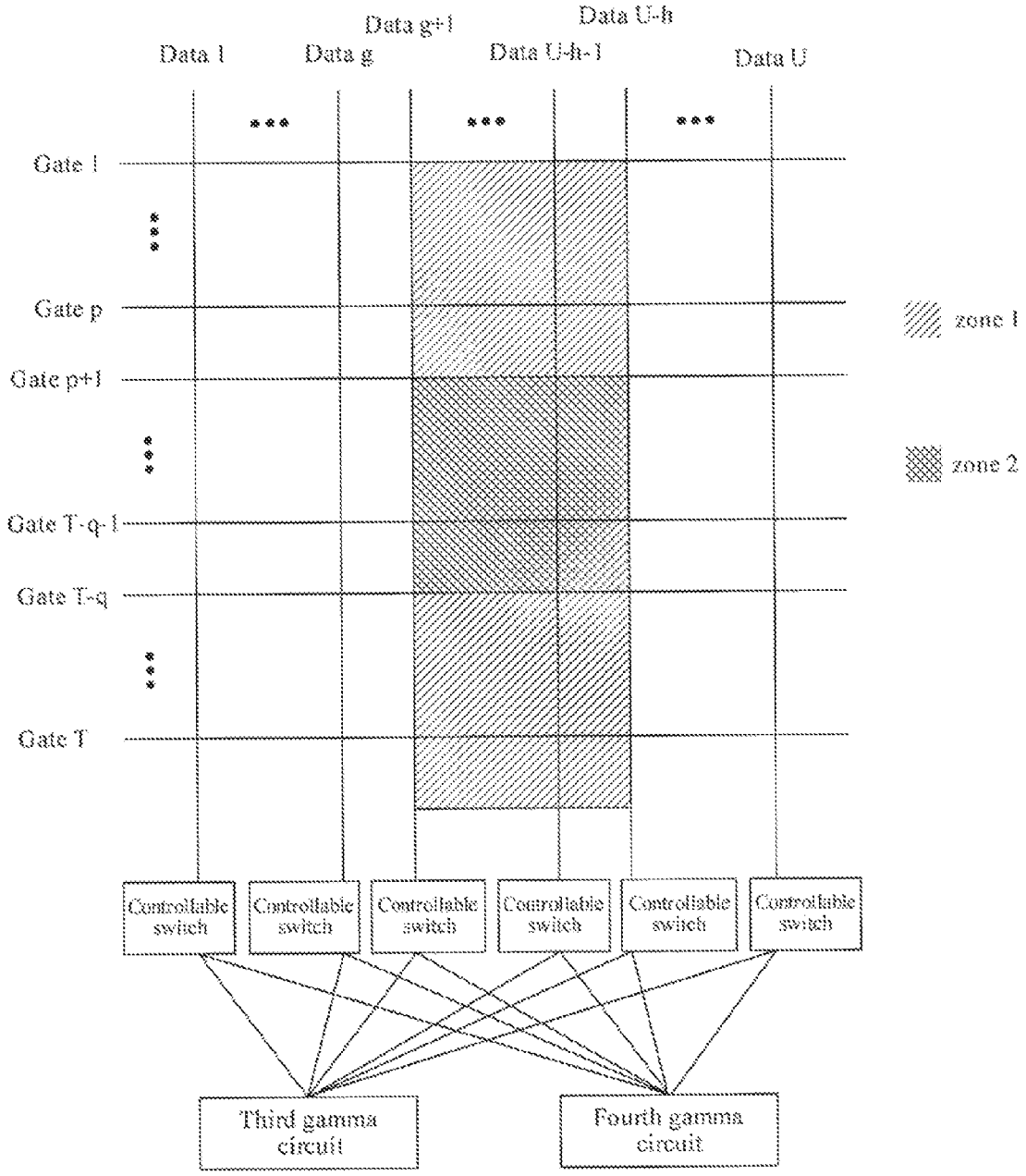
FIG. 9 illustrates a connection diagram of respective gamma circuits and data lines in a display panel in driving by the method of driving a display device illustrated in FIG. 8.

With the method of driving a display device illustrated in FIG. 8, the flicker at the pixels in both the zone 1 and the zone 2 of the display panel illustrated in FIG. 9 will be the lowest, and at this time the flicker on the display panel will further tend to be uniform.

Similarly, the ranges of values for p, q, g and h can vary when the display panel can be divided into at least two zones other than the middle area of the display panel and the peripheral area of the display panel. If the two zones are other than the middle area of the display panel and the peripheral area of the display panel, then $1 \le p+1 \le T$ and $T-q \ge p+1$, so $0 \le p \le T-1$ and $q<T-p-1$. Alike $1 \le g+1 \le U$ and $g+1 \le U-h$, so $0 \le g \le U-1$ and $h \le U-g-1$.

In practice, as to the number of panels into which the display panel is divided, when there is only one common electrode line in the display panel and the respective data lines in the display panel are powered by the same data line signal output circuit, the flicker at the respective pixels in the display panel is observed, and a result of observation shows, for example, significant differences in flicker at the pixels in the three zones A, B, and C in the display panel, and at this time the display panel can be divided into three panels, and the data lines connected with the pixels in the three panels can be powered respectively by three data line signal output circuits.

Thus the display panel can be divided into at least two zones without any limitation thereto, and if the display panel can be divided into at least a number w of panels, where $w \ge 3$ and w is a positive integer, then the drive circuit of a display panel according to the embodiment of the invention comprises at least a number w of data line signal output circuits. Each of the data lines can be selectively connected one of the data line signal output circuits as needed. The differences in optimum Vcom value between the different zones can be compensated by the data voltages output by the corresponding data line signal output circuits for the lowest flicker in the respective different zones or for the uniformity of flicker throughout the display panel at the same common voltage Vcom applicable through the display panel.

Those skilled in the art can appreciate that the drawings are merely schematic diagrams of preferred embodiments of the invention and not all of the modules or flows in the drawings are necessarily needed for the invention to be put into practice.

Those skilled in the art can appreciate that the modules in the devices according to the embodiments can be distributed in the devices of the embodiments as described in the embodiments or located in one or more other devices than the embodiments in question while being adapted correspondingly. The modules in the foregoing embodiments can be integrated into a module or further split into a plurality of sub-modules.

The foregoing description of specific embodiments of the invention have been presented for purposes of illustration and description. The embodiments were chosen and described in order to best explain the principles of the invention and its practical application.

However, the order presented herein will not intend to indicate any precedence of one embodiment over the other.

Evidently those skilled in the art can make various modifications and variations to the invention without departing from the essence and scope of the invention. Thus the invention is also intended to encompass these modifications and variations thereto so long as the modifications and variations come into the scope of the appended claims and their equivalents.

What is claimed is:

1. A driving circuit of a display panel comprising a plurality of pixels arranged in a matrix, wherein the display panel further comprises j select circuits and j data line signal output circuits, wherein j is an integer greater than or equal to 2;

each data line on the display panel is connected with an associated select circuit, different data lines on the display panel are connected with different select circuits, and each of the j select circuits is connected with the j data line signal output circuits;

each of the j data line signal output circuits is configured, upon displaying a pixel on the display panel, generate a voltage signal according to a grayscale value to be displayed at the pixel and to apply the voltage signal to a data line connected with the pixel;

each of the j select circuits is configured to control an associated data line connected therewith to be connected with one of the j data line signal output circuits and to control the associated data line connected therewith to be disconnected from the other ones of the j data line signal output circuits; and when a same grayscale is required, at least two of j positive grayscale voltages output by the j data line signal output circuits are different, and negative grayscale voltages output by data line signal output circuits outputting different positive grayscale voltages are also different; wherein when the same grayscale is required, for two of the j data line signal output circuits, $V1_{g+}-V2_{g+}=V1_{g-}-V2_{g-}=Vcom_{1R}-Vcom_{2R}$;

$V1_{g+}$ is a positive grayscale voltage output by a first one of two data line signal output circuits; and $V2_{g+}$ is a positive grayscale voltage output by a second one of the two data line signal output circuits;

$V1_{g-}$ is a negative grayscale voltage output by the first data line signal output circuit and $V2_{g-}$ is a negative grayscale voltage output by the second data line signal output circuit and $Vcom_{1R}$ is a voltage of a common electrode line required for a pixel connected with a data line powered by the first data line signal output circuit and $Vcom_{2R}$ is a voltage of a common electrode line required for a pixel connected with a data line powered by the second data line signal output circuit.

2. The driving circuit of claim 1, wherein the select circuits are controllable switches.

3. The driving circuit of claim 1, wherein the data line signal output circuits are gamma circuits.

4. A display panel, comprising the driving circuit of the display panel according to claim 1.

5. The display panel of claim 4, wherein the select circuits are controllable switches.

6. The display panel of claim 4, wherein the data line signal output circuits are gamma circuits.

7. A display device, comprising the driving circuit of the display panel according to claim 1.

8. The display device of claim 7, wherein the select circuits are controllable switches.

9. The display device of claim 7, wherein the data line signal output circuits are gamma circuits.

10. A method of driving a display device comprising a display panel and the driving circuit of the display panel, the display panel in the display device comprising a plurality of gate lines and a plurality of rows of pixels, and each of the gate lines being electrically connected with one of the rows of pixels, the method comprising:

controlling one of the j data line signal output circuits to be connected with a data line connected with one of the pixels in the display panel when a gate line, which is connected with the pixel, is enabled; wherein a flicker at the pixel when the data line connected with the pixel is powered by the one of the j data line signal output circuits is lower than a flicker at the pixel when the data line connected with the pixel is powered by any other one of the j data line signal output circuits when the gate line connected with the pixel is enabled; and providing a same common voltage on a common electrode line connected with the respective pixels in the display panel; wherein when the same grayscale is required, for two of the j data line signal output circuits, $V1_{g+}-V2_{g+}=V1_{g-}-V2_{g-}=Vcom_{1R}-Vcom_{2R}$;

$V1_{g+}$ is a positive grayscale voltage output by a first one of the two data line signal output circuits; and $V2_{g+}$ is a positive grayscale voltage output by a second one of the two data line signal output circuits;

$V1_{g-}$ is a negative grayscale voltage output by the first data line signal output circuit and $V2_{g-}$ is a negative grayscale voltage output by the second data line signal output circuit and $Vcom_{1R}$ is a voltage of a common electrode line required for a pixel connected with a data line powered by the first data line signal output circuit and $Vcom_{2R}$ is a voltage of a common electrode line required for a pixel connected with a data line powered by the second data line signal output circuit.

11. The method of claim 10, wherein j=2, and the j data line signal output circuits comprise a first data line signal output circuit and a second data line signal output circuit, further comprising:

controlling the first data line signal output circuit to be connected with the first data line to the k-th data line through the select circuits and the first data line signal output circuit to be connected with the (M−l)-th data line to the M-th data line, wherein k is an integer greater than 0 and smaller than or equal to M/2−1; l is an integer greater than or equal to 0 and smaller than or equal to M/2−1; and M is the number of data lines in the display panel; and controlling the second data line signal output circuit to be connected with the (k+l)-th data line to the (M−l−1)-th data line when any of the (r+1)-th gate line to the (N−s−1)-th gate line is enabled, r is an integer greater than 0 and smaller than or equal to N/2−1; s is an integer greater than or equal to 0 and smaller than or equal to N/2−1; and N is the number of gate lines in the display panel.

12. The method of claim 11, further comprising:

controlling the first data line signal output circuit to be connected with the (k+l)-th data line to the (M−l−1) data line when any of the first gate line to the r-th gate line is enabled or when the (N−s)-th gate line to the N-th gate line are enabled.

13. The method of claim 10, wherein j=2, and the j data line signal output circuits comprise a third data line signal output circuit and a fourth data line signal output circuit, further comprising:

controlling the third data line signal output circuit to be connected with the (g+1)-th data line to the (U−h−1)-th data line when any of the first gate line to the p-th gate line is enabled or the (T-q)-th gate line to the T-th gate line are enabled, wherein p is an integer greater than 0 and smaller than or equal to T/2−1; q is an integer greater than or equal to 0 and smaller than or equal to T/2−1; T is the number of gate lines in the display panel; g is an integer greater than 0 and smaller than or equal to U/2−1; h is an integer greater than or equal to 0 and smaller than or equal to U/2−1; and U is the number of data lines in the display panel ; and controlling the fourth data line signal output circuit to be connected with the (g+1)-th data line to the (U−h−1)-th data line when any of the (p+1)-th gate line to the (T−q−1)-th gate line is enabled.

14. The method of claim 10, wherein the select circuits are controllable switches.

15. The method of claim 10, wherein the data line signal output circuits are gamma circuits.

* * * * *